US005477723A

United States Patent [19]

Kergen

[11] Patent Number: 5,477,723

[45] **Date of Patent: * Dec. 26, 1995**

[54] DEVICE FOR REGULATING THE BLANK-HOLDING FORCE IN A PRESS

[75] Inventor: Richard Kergen, Fexhe-le-Haut-Clocher, Belgium

[73] Assignee: Recherche et Development Groupe Cockerill Sambre, Seraing, Belgium

[ * ] Notice: The portion of the term of this patent subsequent to Jun. 12, 2009, has been disclaimed.

[21] Appl. No.: 751,409

[22] Filed: Aug. 28, 1991

[30] Foreign Application Priority Data

Aug. 30, 1990 [BE] Belgium ..... 9000841

[51] Int. Cl.[6] ..... B21D 24/08

[52] U.S. Cl. ..... 72/350; 72/347

[58] Field of Search ..... 72/350, 351, 417, 72/347, 453.13

[56] References Cited

U.S. PATENT DOCUMENTS

| | | | |
|---|---|---|---|
| 1,619,069 | 3/1927 | Glasner et al. | 72/351 |
| 3,948,075 | 4/1976 | Finsterwalder et al. | 72/417 |
| 4,316,379 | 2/1982 | Anderson | 72/347 |
| 4,745,792 | 5/1988 | Story et al. | 72/351 |
| 4,833,903 | 5/1989 | de Smet | 72/350 |

FOREIGN PATENT DOCUMENTS

| | | | |
|---|---|---|---|
| 1196075 | 12/1985 | U.S.S.R. | 72/347 |
| 1574320 | 6/1990 | U.S.S.R. | 72/351 |

*Primary Examiner*—Lowell A. Larson
*Attorney, Agent, or Firm*—Charles F. Meroni, Jr.

[57] ABSTRACT

Fluidic regulating device intended to be placed between a blank-holder and the sliding member serving to displace the blank-holder. It comprises for example a body (11) intended to be mounted on the abovementioned sliding member (4) in such a way as to be driven by the latter, said body (11) accommodating at least one compact fluidic jack (12) and comprising at least one pipe (13) for feeding a pressurized fluid into the jack or jacks (12), the piston (15) of each jack being attached to a movable member (16) intended to work in conjunction with and displace the blank-holder (3) with respect to said body (11), in such a way that, when the displacement of the abovementioned sliding member is stopped by a stop (18), before the blank-holder (3) has come into contact with a blank placed on or against the die (2), the force exerted by the blank-holder on said blank is determined by the pressure of the fluid injected into said jack (12) and can vary during the stamping cycle.

18 Claims, 5 Drawing Sheets

DEVICE FOR REGULATING THE BLANK-HOLDING FORCE IN A PRESS

The present invention relates to a fluidic device for regulating the blank-holding force in a stamping press.

A stamping press essentially comprises a table on which is fixed a die with an impression whose pattern is that of the outside surface of the part to be stamped, a blank-holder serving to fix the sheet metal blank to be stamped and a punch fixed to the slider of the press, this punch having a pattern which is complementary to that of the impression of the die. When the punch applies a pressure to a blank placed on the die, it deforms the blank in the space between the die and the punch.

The blank-holder applies a clamping pressure to the surfaces of the blank for the purpose of preventing the crinkling of the sheet metal as a result of the hammering effect. The clamping pressure applied by the blank-holder can furthermore serve to create a strong tension in the pressing skirt in the case of conical pressings or for calibration by over-punch drawing for example.

On a conventional mechanical or hydraulic press, the blank-holder and the punch can be mounted above the die, the clamping pressure and the stamping force being applied downward, or can be mounted below the matrix, in which case the clamping pressure and the stamping force are applied upward. In the first arrangement, the blank-holder is formed from a movable piece operated by hydraulic jacks or by a drive mechanism. These devices apply a clamping force which is usually maintained constant during the stamping operation while the stamping force applied on the punch varies as a function of the travel of the punch and passes through a maximum. However, there is a certain advantage in varying the blank-holding force during the travel of the punch, for example in order to maintain the force of the punch at its maximum permissible level during the stamping cycle in order to make maximum use of the deformation capabilities of the metal. Now the known devices hardly allow the blank-holding force to be varied, at least with sufficiently high dynamic performance.

In fact, the jacks of a hydraulic press mounted in a known way above a blank-holder generally work at the end of travel and, because of this, the volume of fluid to be compressed is very great, which has the consequence of very substantially limiting the dynamic performance of a system for regulating the pressure acting directly on the blank-holding hacks of the press. As for mechanical control of the blank-holder, this hardly allows the regulation of pressure during a cycle and the addition of a passive hydraulic system, such as has already been achieved, serves only to stabilize the clamping pressure and in no way changes the impossibility of regulating the pressure during a cycle.

In the second on-press arrangement, in which the blank-holder and the punch are mounted below the die, the blank-holder rests on columns which bear on the hydraulic or pneumatic cushion of the press. A hydraulic cushion however provides only poor dynamic performance in terms of force regulation and a pneumatic cushion gives no possibility of controlled variation of pressure during a cycle. In brief, the known presses offer only limited possibilities of varying the blank-holding force in a controlled manner during a stamping cycle.

The purpose of the present invention is to propose a device which can be adapted to a conventional hydraulic or mechanical press and which allows the blank-holding force to be varied in a controlled manner with excellent dynamic performance.

This purpose is achieved by virtue of the invention by means of a fluidic regulating device which is placed between the blank-holder and the sliding member serving to displace the blank-holder.

According to a first aspect of the invention, one exemplary embodiment comprises a body intended to be mounted on the abovementioned sliding member in such a way as to be driven by the latter, said body accommodating at least one compact fluidic jack and comprising at least one pipe for feeding a pressurized fluid into the jack, the piston of each jack being attached to a movable member intended to work in conjunction with and displace the blank-holder with respect to said body, in such a way that, when the displacement of the abovementioned sliding member is stopped by a stop, before the blank-holder has come into contact with a blank placed on or against the die, the force exerted by the blank-holder on said blank is determined by the pressure of the fluid injected into said jack and can vary during the stamping cycle.

According to a second aspect of the invention, the pressurized fluid is fed by means of a regulating valve arranged to regulate the pressure of the fluid in response to a regulating signal (R) representing the difference between the effective pressure (P) of the fluid at the outlet of the valve and a pressure command (C) determined from at least one measurement signal (M) generated by at least one measuring sensor and representing at any time the instantaneous relative position of the punch with respect to the die.

Due to the regulation of the blank-holding force that it provides, the invention offers various advantageous possibilities for solving practical problems in the production of pressings. For example, the invention allows the stamping force to be maximized in order to minimize the dimensions of the blank, or the elimination of the elastic return of a stamping in order to obtain a high precision in the stamped part, or again to avoid the appearance of crinkles in the skirt of the stamping and to thus maximize the reduction ratio which can be achieved in one pass, that is to say the ratio between the diameter of the blank and the diameter of the punch.

Other aspects, characteristics and advantages of the invention will emerge from the following description, in which an exemplary embodiment of the invention is described with reference to the appended drawings.

Figure 1:
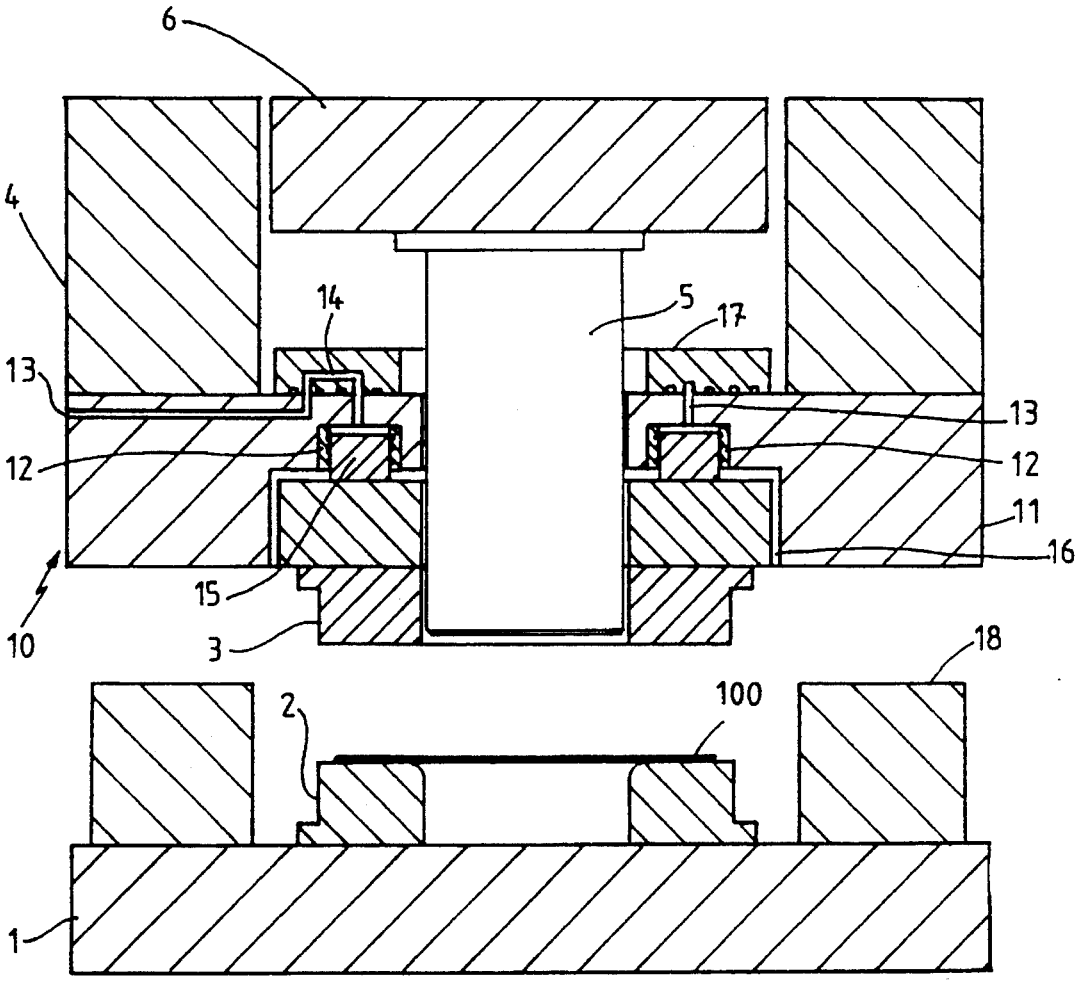
FIG. 1 is a cross-sectional view of a typical hydraulic press in which there is incorporated an exemplary device according to the invention.

FIG. 1 shows an exemplary stamping press of the hydraulic type. This press comprises a table 1 bearing a die 2 with an impression whose pattern is that of the outer surface of a part to be stamped. The reference number 3 denotes a blank-holder intended to apply a pressure on the sheet metal blank to be stamped, the reference number 4 denotes the press slider, the reference number 5 denotes a punch having a pattern which is complementary to that of the impression of the die, and the reference 6 denotes the slider of the punch used to move the punch 5 closer to and away from the die 2.

According to the invention, the blank-holder 3 is not fixed directly to the press slider 4, but by means of an adjustment device 10 of which an exemplary embodiment is described hereafter.

This device according to the invention comprises a body 11 fixed (for example by screws which are not shown) to the slider 4 of the press. In the body 11 are produced housings for compact fluidic jacks 12 having a very short travel. The pistons 15 of the jacks 12 bear on a plate 16 fixed to the blank-holder 3 by means which are not shown. The plate 16 is guided and locked with respect to the body 11 by any means (which are not shown) which are currently used in press tools. The body 11 comprises at least one pipe 13 for feeding a pressurized fluid coming from any fluid source (the fluid source of the press or an independent supply).

In the embodiment shown, the body 11 bears a connection plate 17 comprising several channels 14 for connecting several jacks 12 to a feed pipe 13 in an interchangeable manner. The connections can be modified simply by replacing one connection plate by another. The fluid-tightness between the connecting plate 17 and the body 11 is provided by means of "O-ring" seals for example. The jacks are in principle single acting jacks. The jacks can also be annular jacks whose axis coincides with the axis of the tool or can be pockets of elastomer material, for example, or any other device capable of producing an axial pressure by means of a pressurized fluid.

Figure 2:
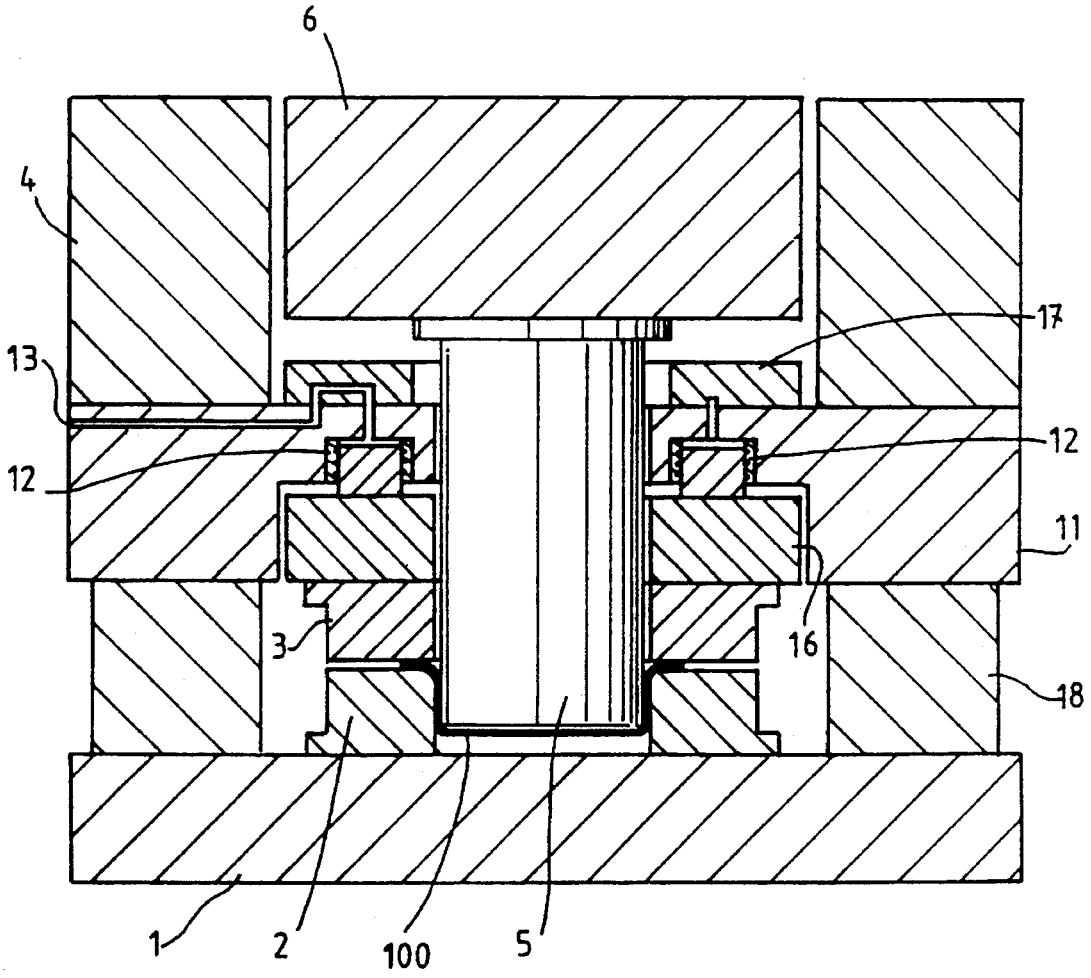
FIG. 2 is a similar view to that of FIG. 1, showing the machine at the end of a stamping operation.

During operation, the slider 4 of the press descends by driving the body 11, the plate 16 and the blank-holder 3 toward the table 1 of the machine. The body 11 follows its descending travel until it touches a stop 18 which in this case is fixed on the table of the machine. The height of the stop 18 and the play between the body 11 and the plate 16 are adjusted in order that the bearing force is applied to the stop 18 and not to the die 2 or to the blank 100 placed on the die. When the body 11 bears on the stop 18, the jacks 12 are pressurized by injecting a fluid into them while the punch 5 is displaced downward in order to produce a stamping (FIG. 2). By varying the pressure of the fluid injected into the jacks, it is thus possible to modify the force applied to the blank-holder, which modifies the force exerted by the punch as the latter has a component which is directly related to the blank-holding force. It is thus possible to vary the pressure of the fluid in the jacks in such a way that the blank-holding force varies in such a way that the punch 5 can work with a constant force.

Figure 3:
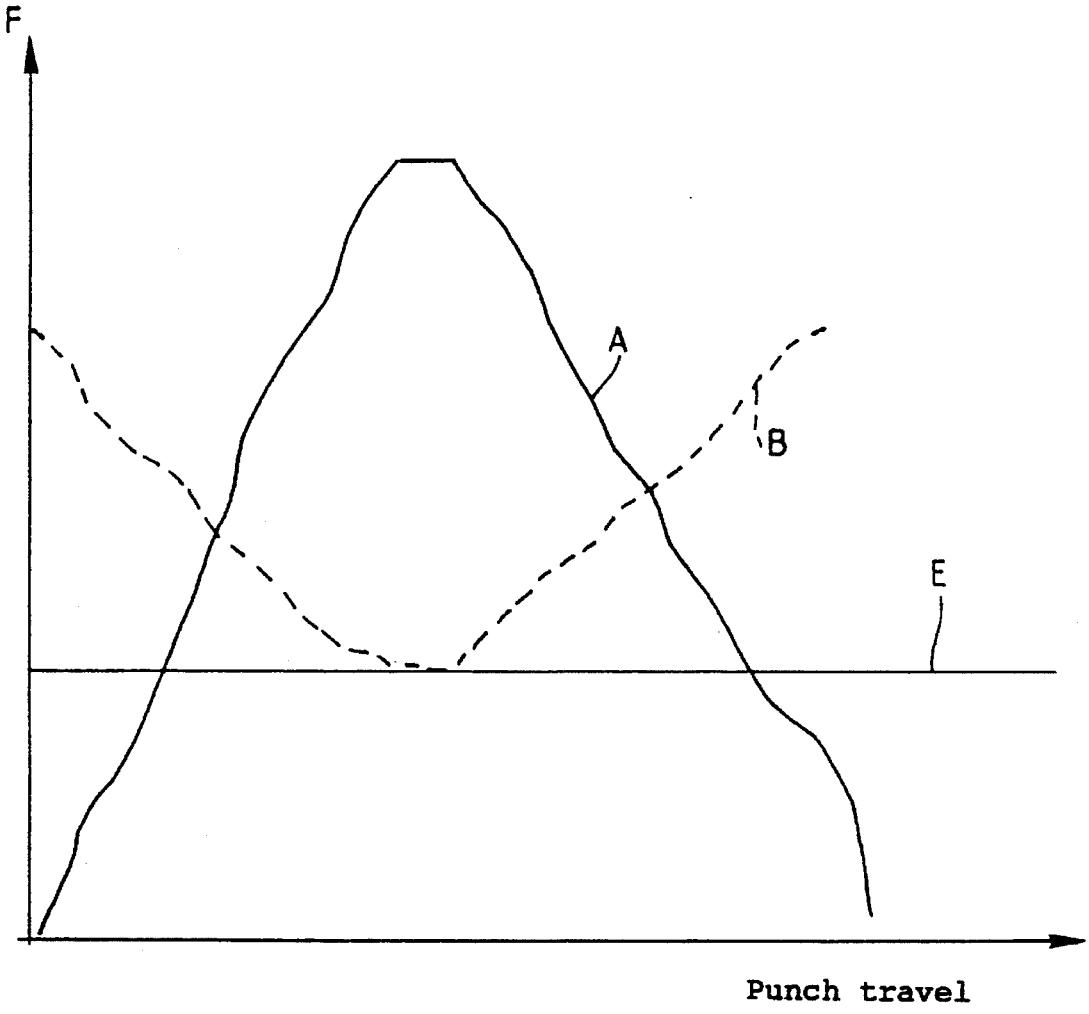
FIG. 3 is a diagram showing an example of variation of the blank-holding force achieved with the device according to the invention.

Curve A in FIG. 3 shows a typical variation in the force of a punch when the blank-holding force is maintained constant as in the known technique. The curve B shows an exemplary curve of the variation of the blank-holding force which the device according to the invention allows to be obtained. By adjusting the pressure of the fluid such that the profile of curve B corresponds to the inverted profile of curve A, it is possible to work the punch with a practically constant force, represented by the line E.

It should be noted that, the jacks 12 being very compact, the volume of fluid which they contain is very small and that consequently it is possible to achieve large and steep variations in the force with very small fluid flow rates. The regulating device produced according to the invention is therefore a very sensitive dynamic system, which allows a fine and very reliable dynamic regulation and control to be carried out.

In order to ensure a strict control of the parameters of the regulating system, the device described above is completed by various measuring sensors placed on the machine. One or more pressure sensors can be provided to measure the pressure in the jacks 12: it is possible, for example, to use piezoelectric pressure sensors of the 4283A200 type produced by the Kistler Company. A displacement sensor can be provided to measure the position of the punch 5 with respect to the die 2: it is possible for example to use a displacement sensor of the Temposonic make having a measurement accuracy of 0.1 mm. Another displacement sensor can be provided to measure the space between the blank-holder 3 and the die 2: it is possible for example to use an inductive displacement sensor having a high accuracy of 0.01 mm. A force sensor, of the piezoelectric type for example, can be provided between the punch 5 and the slider in order to measure the stamping force.

The electrical voltage or current signals produced by the abovementioned sensors and which are proportional to the measured magnitudes, are used for continuously generating a pressure command in order to regulate the blank-holding force at all times at the required value as a function of the dynamic parameters of the press.

Figure 4:
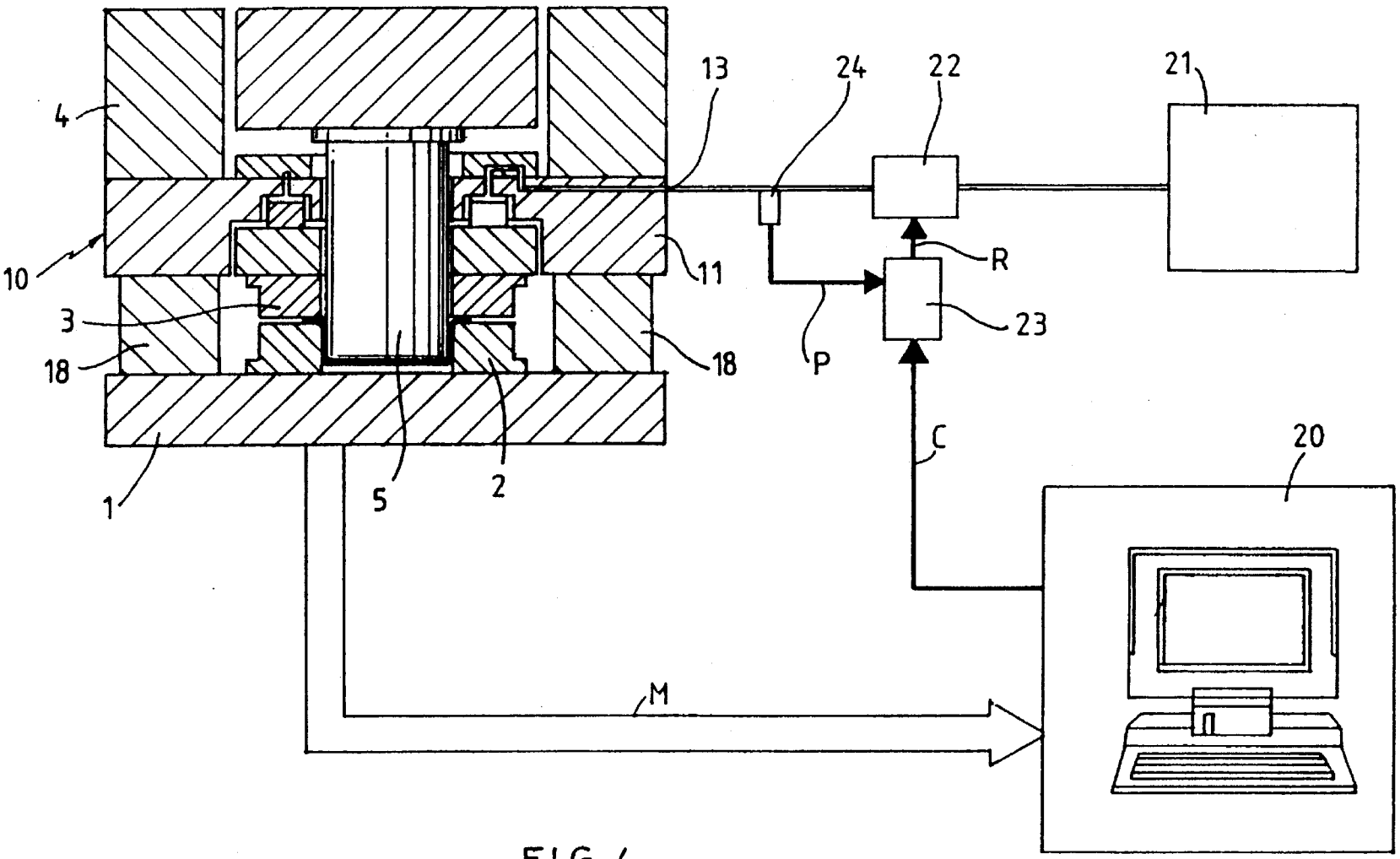
FIG. 4 is an overall diagram of a regulating system organized around the device according to the invention.

FIG. 4 is an overall diagram of a dynamic regulating system organized around the pressure regulating device according to the invention. An independent hydraulic generator 21 or the hydraulic system of the machine supplies a pressurized fluid to the jacks 12 by means of a regulating valve 22, for example a high performance servo-valve such as the Moog series D760 valve or a proportional valve. The valve 22 is coupled with a regulating board 23 receiving on a first input a signal P representing the measurement of the pressure at the output of the valve 22 made by means of a pressure sensor 24. The regulating board 23 receives a command signal C representing a pressure command on another input. The regulating board 23 is arranged to determine the difference between the measured pressure and the pressure command and to produce a regulating signal R for the valve 22 in order to reduce the said pressure difference to zero.

The pressure command C is determined by a processor 20 from the measurement signals M produced by the sensor or sensors by performing mathematical computations and/or logic tests adapted to the particular application in question.

The following examples illustrate the application of the system according to the invention to several typical exemplary cases. When it is desired to maximize the stamping force in order to minimize the dimensions of the blank, it is possible, for example, to generate the pressure command C according to the variation profile illustrated by curve B in FIG. 3, this profile having been determined experimentally by an initial test at constant pressure. The pressure command C is then generated as a function of the position of the punch 5, measured by a displacement sensor and as a function of the difference between the maximum acceptable punch force and the actual force measured by a force sensor. It is also possible to generate the pressure command as a function of the measurement of the force of the punch and as a function of a predetermined regulation logic.

In the case in which it is desired to eliminate the elastic return of the stamping in order to obtain a great accuracy in the stamped part, it is possible to suddenly increase the blank-holding pressure at the end of the stamping in order to reduce or eliminate the slipping of the blank between the die 2 and the blank-holder 3, and to thus cause an expanding deformation over the punch 5.

It is also possible, by means of the device of the invention, to bring the effective blank-holding force to the minimum value which is strictly necessary in order to prevent the appearance of crinkles between the blank-holder and the die and to thus maximize the reduction ratio (the diameter of the blank in relation to the diameter of the punch) which can be achieved in one pass. This result can be achieved by means of the invention by measuring the distance between the die 2 and the blank-holder 3 by means of a displacement sensor. In effect, the distance between the die and the blank-holder increases as soon as crinkles appear. From the measurement of this distance, the processor generates the pressure command according to a regulation logic which is capable of minimizing the blank-holding pressure to the value which is Just necessary to prevent the development of crinkles. The device can also be applied for controlling the crinkles appearing in the skirt of a conical stamping, either by developing an appropriate blank-holding force profile comprising for example a cyclic variation having an evolving mean value, or by regulating the blank-holding force on the basis of the measurement of the amplitude of the crinkles in the skirt of the stamping, this measurement being supplied for example by displacement sensors or by an optical system analyzing the visual appearance of the skirt during the stamping.

Figure 5:
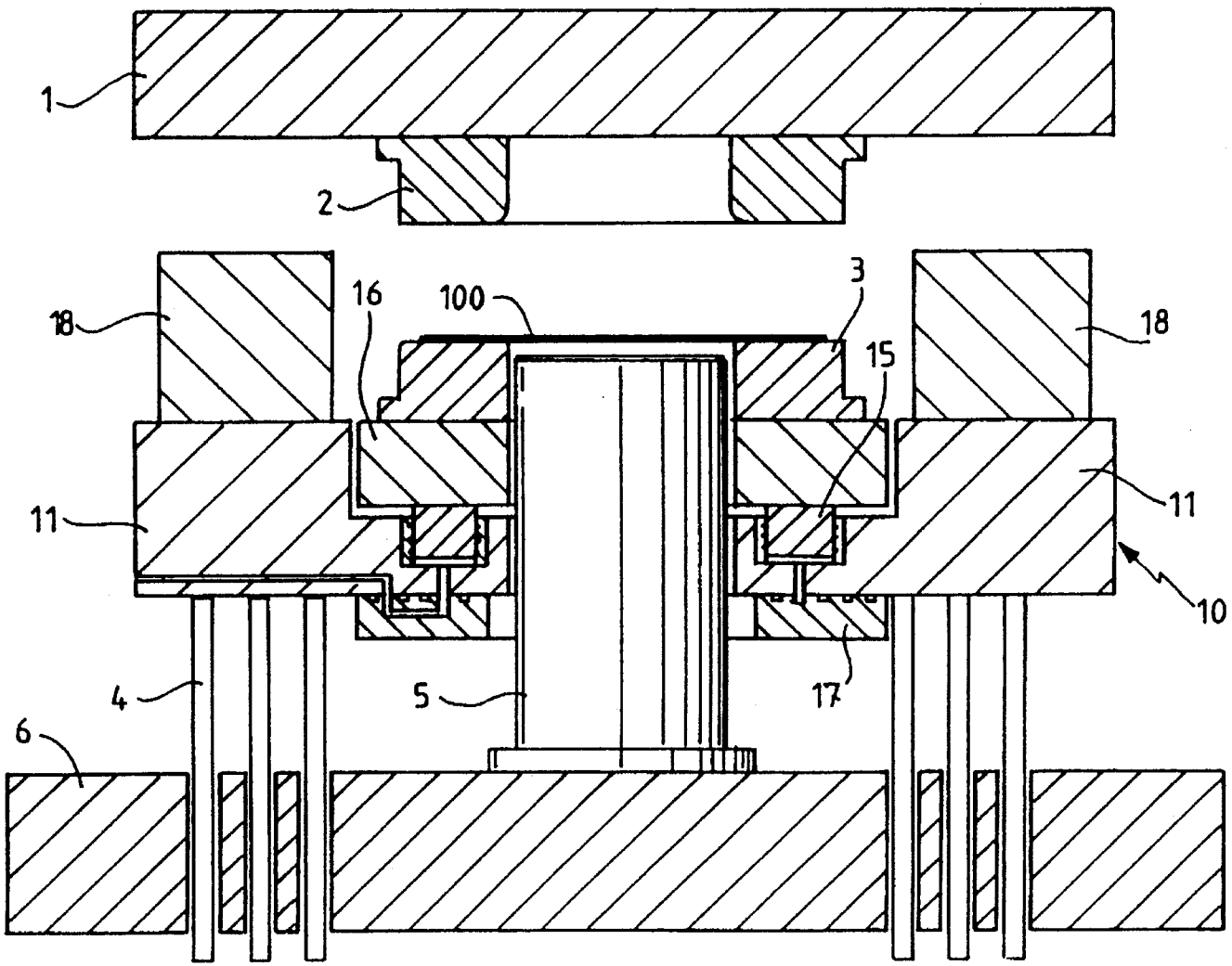
FIG. 5 shows the application of the device according to the invention in a second typical type of hydraulic press.

The device according to the invention is obviously also adaptable to a stamping press in which the punch and the blank-holder are mounted below the die. FIG. 5 shows this application. In this figure there can be seen the press slider 1 with the die 2, the blank-holder 3 bearing a blank 100 to be stamped and the punch 5 resting on the press table 6. The body 11 of the device according to the invention here rests on sliding columns 4. The blank-holder 3 rests on the moving member 16 which moves in conjunction with the pistons 15 of the jacks 12 housed in the body 11 as described above. The stops 18 intended to limit the distance between the slider 1 and the body 11 are here borne by the body 11. The functioning of the device for regulating the blank-holding pressure is in every way similar to that of the embodiment shown in FIG. 1. During the descent of the slider 1, the latter comes up against the stops 18 and drives the body 11 downward. The latter is brought into pressure against the slider 1 by means of the stops 18 under the effect of the columns 4 which bear on a hydraulic or pneumatic cushion which is not shown. The blank-holding force on the blank 100 clamped between the die 2 and the blank-holder 3 is produced as above by means of jacks 15. All of the parts described above continue their downward travel; the punch 5, which rests on the table of the press, is fixed and the sheet metal is pressed between this punch 5 and the die 2. The force of the press cushion is always greater than the force applied by the assembly of jacks 15.

It is of course understood that the device according to the invention may be embodied in various ways. It can be produced in order to adapt to and to be mounted on an existing stamping press as in the embodiment described above by way of example. The device according to the invention can also be built into any new stamping press in various embodiments.

I claim:

1. A device for regulating the blank-holding force in a stamping press comprising a die (2), a sliding member (4) on which is mounted a blank-holder (3), and a punch (5), which comprises a body (11) intended to be mounted on the abovementioned sliding member (4) in such a way as to be driven by the latter, said body (11) accommodating at least one compact fluidic jack (12) and comprising at least one pipe (13) for feeding a pressurized fluid into each jack (12), a piston (15) of each jack being attached to a movable member (16) intended to work in conjunction with and displace the blank-holder (3) with respect to said body (11), in such a way that, when the displacement of the abovementioned sliding member is stopped by a stop (18), before the blank-holder (3) has come into contact with a blank placed on or against the die (2), the force exerted by the blank-holder on said blank is determined by the pressure of the fluid injected into said jack (12) and can vary during the stamping cycle.

2. The device as claimed in claim 1, wherein said body (11) bears a connection plate (17) comprising several channels (14) for feeding a pressurized fluid to several jacks (12) in an interchangeable manner from a feed pipe.

3. The device as claimed in either of claims 1 or 2, wherein the pressurized fluid is fed by means of a regulating valve (22) arranged to regulate the pressure of the fluid in response to a regulating signal (R) representing the difference between the effective pressure (P) of the fluid at the outlet of the valve and a pressure command (C) determined from at least one measurement signal (M) generated by at least one measuring sensor and representing at any time the instantaneous relative position of the punch (5) with respect to the die (2).

4. The device as claimed in claim 3, wherein the pressure command (C) is continuously computed by a processor (20).

5. A stamping press comprising a table (1) on which is fixed a die (2), a sliding member (4) on which is mounted a blank-holder (3), and a punch 5, which comprises a stop (18) to limit the travel of the abovementioned sliding member (4) and a fluidic device comprising, between the blank-holder (3) and the abovementioned sliding member (4), at least one compact fluidic jack (12) the body of said jack being integral with the sliding member (4) and a piston (15) of the jack being attached to the blank-holder (3) in order to displace the blank-holder (3) with respect to the sliding member (4) when a pressurized fluid is injected into said jack, and in order that when the displacement of the sliding member (4) is stopped by the stop (18) before the blank-holder has come into contact with a blank placed on or against the die (2), the force applied by the blank-holder to said blank is determined by the pressure of the fluid injected into the jack (12) and can vary during the stamping cycle.

6. The stamping press as claimed in claim 5, wherein the compact fluidic jack or jacks are housed in a body (11) mounted on the abovementioned sliding member (4) in order to be driven by the latter, said body comprising at least one pipe (13) for feeding a pressurized fluid into each jack, the piston (15) of each jack being attached to the blank-holder (3) in order to displace the blank-holder with respect to the body (11) when a pressurized fluid is injected into the jack or jacks.

7. The stamping press as claimed in claims 5 or 6, wherein the stop (18) is mounted on the table (1) of the press.

8. The stamping press as claimed in either claim 5 or claim 6, wherein the stop (18) is integral with the sliding member (4) which drives the blank-holder.

9. The stamping press as claimed in either claim 5 or claim 6, wherein the pressurized fluid is fed by means of a regulating valve (22), arranged to regulate the pressure of the fluid in response to a regulating signal (R) representing the difference between the effective pressure (P) of the fluid at the outlet of the valve and a pressure command (C) determined from at least one measurement signal (M) generated by at least one measuring sensor and representing at any time the instantaneous relative position of the punch (5) with respect to the die (2).

10. The stamping press as claimed in claim 9, wherein the pressure command (C) is continuously computed by a processor (20).

11. A stamping press comprising a table on which is mounted a die, a sliding member adapted to be moved towards and away from the table, a blank-holder attached to the sliding member, a punch mounted on a movable member so as to be moved towards and away from the table in coaxial alignment with the die, stop means arranged so as to limit the movement of the sliding member towards the table, at least one compact fluidic jack attached to the sliding member, a piston of each jack being attached to the blank-holder so as to displace the latter with respect to the sliding member when a pressurized fluid is fed into each jack, wherein said pressurized fluid is fed by means of a regulating valve arranged to regulate the pressure of the fluid in response to a regulating signal representing the difference between the effective pressure of the fluid at the outlet of the valve and a pressure command generated by at least one measuring sensor and representing at least one dynamic parameter of the stamping press, such that when the displacement of the above mentioned sliding member is stopped by a stop, before the blank-holder has come into contact with a blank placed on or against the die, the force exerted by the blank-holder on said blank is determined by the pressure of the fluid injected into said jack and can vary during the stamping cycle.

12. The stamping press as defined in claim 11, wherein the stop is mounted on the table of the press.

13. The stamping press as defined in claim 11, wherein the stop is integral with the sliding member which drives the blank-holder.

14. The stamping press as defined in claim 11, wherein the compact fluidic jack or jacks are housed in a body mounted on the above mentioned sliding member in order to be driven by the latter, said body comprising at least one pipe for feeding a pressurized fluid into each jack, the piston of each jack being attached to the blank-holder in order to displace the blank-holder with respect to the body when a pressurized fluid is injected into the jack or jacks.

15. The stamping press as defined in any one of claims 11 to 14, wherein the pressurized fluid is fed by means of a regulating valve, arranged to regulate the pressure of the fluid in response to a regulating signal (R) representing the difference between the effective pressure (P) of the fluid at the outlet of the valve and a pressure comment (C) determined from at least one measurement signal (M) generated by at least one measuring sensor and representing at any time the instantaneous relative position of the punch with respect to the die, wherein the pressure comment (C) is continuously computed by a processor.

16. A method of regulating the pressure of the fluid in an apparatus as defined in claim 11, comprising the step of varying the pressure of fluid in the fluidic jack such that the variation of the blank-holder force is caused to follow a variation profile opposite to the variation profile of the force applied by the punch when the blank holder force is kept constant.

17. A method of regulating the pressure of the fluid in an apparatus as defined in claim 11, comprising the step of varying the pressure of the fluid in the fluidic jack as a function of the distance between the blank-holder and the die thereby to keep the blank-holder force to the minimum value which is strictly necessary to prevent the appearance of crinkles between the blank-holder and the die.

18. In combination with a stamping press comprising a table on which is mounted a die, a sliding member adapted to be moved towards and away from the table, a blank-holder attached to the sliding member and a punch mounted on a movable member so as to be moved towards and away from the table in coaxial alignment with the die, a system for controlling the force exerted by the blank-holder on a blank placed on or against the die, comprising: stop means arranged on the stamping press so as to be able to limit the movements of the sliding member towards the table, at least one compact fluidic jack attached to the sliding member, a piston of each jack being attached to the blank-holder so as to displace the latter with respect to the sliding member when a pressurized fluid is fed into each jack, wherein said pressurized fluid is fed by means of a regulating valve arranged to regulate the pressure of the fluid in response to a regulating signal representing the difference between the effective pressure of the fluid at the outlet of the valve and a pressure command generated by at least one measuring sensor and representing at least one dynamic parameter of the stamping press, such that when the displacement of the above mentioned sliding member is stopped by a stop, before the blank-holder has come into contact with a blank placed on or against the die, the force exerted by the blank-holder on said blank is determined by the pressure of the fluid injected into said jack and can vary during the stamping cycle.

* * * * *